US005871102A

United States Patent [19]

Lambert

[11] Patent Number: 5,871,102

[45] Date of Patent: Feb. 16, 1999

[54] BIN LOADER PACKAGE AND METHOD

[75] Inventor: William E. Lambert, Doswell, Va.

[73] Assignee: Union Camp Corporation, Princeton, N.J.

[21] Appl. No.: 814,325

[22] Filed: Mar. 11, 1997

Related U.S. Application Data

[63] Continuation-in-part of Ser. No. 733,279, Oct. 17, 1996, which is a continuation-in-part of Ser. No. 597,949, Feb. 7, 1996.

[51] Int. Cl.[6] ..... B65D 85/62

[52] U.S. Cl. ..... 206/738; 206/449; 229/23 A; 229/117.13; 414/786

[58] Field of Search ..... 206/449, 555, 206/737, 738, 739, 215; 229/120.01, 117.13–117.16, 123, 23 A; 414/786

[56] References Cited

U.S. PATENT DOCUMENTS

| | | | |
|---|---|---|---|
| 1,041,690 | 10/1912 | Snyer | 229/23 A |
| 2,131,349 | 9/1938 | Kreider, Jr. | 229/23 A |
| 2,189,410 | 2/1940 | Stute | 229/23 A |
| 2,246,097 | 6/1941 | Illges | 229/23 A |
| 2,332,192 | 10/1943 | Becker | 229/23 A |
| 3,184,138 | 5/1965 | Ridgeway, Jr. . | |
| 3,631,972 | 1/1972 | Gendron . | |
| 3,750,932 | 8/1973 | Ellison . | |
| 3,799,406 | 3/1974 | Goerke . | |
| 3,820,686 | 6/1974 | Tyrseck . | |
| 3,903,643 | 9/1975 | Blackmore et al. . | |
| 3,921,892 | 11/1975 | Macie . | |
| 4,210,273 | 7/1980 | Hegele . | |
| 4,397,406 | 8/1983 | Croley . | |
| 4,530,459 | 7/1985 | Maroszek | 229/23 A |
| 4,556,210 | 12/1985 | George . | |
| 4,770,301 | 9/1988 | Nagel . | |
| 4,802,586 | 2/1989 | George . | |
| 4,830,186 | 5/1989 | George et al. . | |
| 4,858,414 | 8/1989 | Meschi . | |
| 4,964,511 | 10/1990 | Meschi . | |
| 5,064,113 | 11/1991 | Hauber et al. . | |
| 5,167,205 | 12/1992 | Bell et al. | 229/23 A |
| 5,251,819 | 10/1993 | McHugh . | |
| 5,261,595 | 11/1993 | Nanno et al. . | |
| 5,348,147 | 9/1994 | Gottfried . | |
| 5,507,430 | 4/1996 | Imhoff | 229/117.13 |

*Primary Examiner*—Jimmy G. Foster
*Attorney, Agent, or Firm*—Dennis H. Lambert

[57] ABSTRACT

A bin loader package for shipping, storing and dispensing cut paper directly into the paper supply bin of a photocopier, printer or other equipment which uses the paper and which has a storage compartment for storing a supply of paper used in the operation of the equipment. The package includes a box enclosure having opposite side walls, opposite end walls, a bottom wall, and a cover or lid, enclosing a stack of paper sheets to protect the paper during shipment, storage and handling. The enclosure is defined by a first member formed from a single blank folded to define the bottom wall and the opposite side and end walls, with the side walls having inturned flaps adhesively attached to the end walls to hold the walls in their erected relationship, defining a wrapper. A second member is folded to define a tray having a bottom wall with a handle at each end. The tray is supported in the box enclosure on the bottom wall of the wrapper and supports the stack of paper. In use, the adhesive attachments are broken so that the side and end walls of the wrapper can be folded down to expose the stack of paper and the tray handles, whereby the tray and stack of paper can be lifted vertically away from the wrapper and deposited onto the elevator platform of the paper supply bin, ready for use of the paper.

13 Claims, 5 Drawing Sheets

BIN LOADER PACKAGE AND METHOD

This application is a continuation-in-part of commonly owned co-pending application Ser. No. 08/733,279, filed Oct. 17, 1996; pending which is, in turn, a continuation-in-part of application Ser. No. 08/597,949, filed Feb. 7, 1996, pending.

BACKGROUND OF THE INVENTION

Photocopiers, printers and like equipment are in widespread use in commercial and office environments. Such equipment generally has a compartment or bin in which a stack of sheets of paper is placed for use by the machine during its operation.

DESCRIPTION OF THE PRIOR ART

This invention relates to packaging, and more particularly, to a package and method for rapidly loading cut paper into the bin of a photocopier, printer, or similar machine. The invention is especially adapted for rapidly loading large quantities of cut paper into the paper supply bin of high-speed photocopying machines, printers, and the like, which typically use large quantities of paper over short periods of time.

The paper for use in such machines generally has been packaged in individual reams covered with a ream wrap material to assist in maintaining the proper condition of the paper, and the wrapped reams are then placed in a cardboard or similar box for shipment and storage. When the need arises for loading paper into a photocopier, printer, or the like, a box is opened and one or more reams of paper are removed from the box, the ream wrap removed, and the paper placed in the bin or other compartment of the machine for supplying paper to the machine during its operation.

This manner of packaging paper for use in such machines has not posed a problem for relatively low volume, low speed machines, since such machines typically hold only one or two reams or even less paper, and use it relatively slowly. However, high speed, high volume photocopiers, printers and similar machines have come into more widespread usage, and these machines generally have relatively large paper holding capacities in order to provide an adequate supply of paper for the greater rate of use due to their higher speed of operation. In spite of the large paper holding capacity of such machines it may be necessary to frequently replenish the supply of paper in the bin. With conventional packaging, it can take considerable time to open the box and then remove and open individual reams of paper so that the paper can be stacked one ream at a time in the supply bin of the machine, which may typically hold five or more reams of paper.

Efforts have been made to solve this problem, as exemplified by U.S. Pat. Nos. 4556210, 4770301, 4802586 and 4830186. These patents disclose various packaging concepts for loading large quantities of paper into the supply bin of a photocopy machine without the necessity of opening individual reams of paper. In these patents, the receptacle for the paper either comprises a specialized device that is intended for use only at the location of the machine, or the carton or package of paper must be at least partially opened before it is placed on the elevator platform of the supply bin in the photocopier or other machine. The remaining part of the carton is then manipulated so that it can be removed from the bin, leaving the paper stacked on the platform. All of these patents (except U.S. Pat. No. 4,830,186) involve fairly complex and expensive constructions. The complexity of their construction increases the difficultly of use. Thus, while the prior art packages enable a large quantity of paper to be stacked in the supply bin of a photocopier or similar machine without requiring individual reams of paper to be opened, the prior art devices are relatively complex and expensive in construction, and/or relatively cumbersome to use, thereby at least partially offsetting the advantages gained by eliminating the need to open and handle individual reams of paper.

Several variations of bin loader package offering solutions to the shortcomings of prior art packages are proposed in prior co-pending application Ser. Nos. 08/597,949 and 08/733,279, commonly owned with this application. The present application is directed to a further improved bin loader package which overcomes the shortcomings of prior art packages, and especially to such a package which is simple and inexpensive to make and easy to use. The present invention thus fulfills the need for a simple and inexpensive package which enables a large quantity of paper to be quickly and easily supplied to the paper supply bin of a photocopier or printer or other machine, without the necessity of separately handling individual reams of paper.

SUMMARY OF THE INVENTION

The present invention provides an exceptionally simple and economical package for shipping, storing and dispensing paper into the paper supply bin of photocopiers, printers, and similar equipment.

The basic concept of the invention is to provide a single stack of loose sheets of paper in a box sized roughly for the capacity of the supply bin of a photocopier, printer, or similar machine. The box is configured to securely confine and protect the loose sheets of paper during shipping, storage and handling, and includes an outer wrapper which is folded in enclosing relationship about a tray holding a stack of paper. The wrapper may be folded downwardly to expose the paper and the tray so that they may be lifted and placed onto the elevator platform of the paper supply bin of the photocopier or other machine.

More specifically, the wrapper comprises a first member that is foldable to define a bottom wall, opposite side and end walls and an open top, and the tray comprises a second member which sits inside the first member and supports the paper thereon. The first and second members are each formed from a single blank of material, such as a corrugated cardboard, and may be easily produced with minor modification to existing machinery, i.e., to insert the tray during the paper bonding process.

The side and end walls of the first member are adhesively attached together to hold them in erected position, and the adhesive bond may be easily broken so that the walls may be folded down to enable access to the tray, which may then be lifted with the paper supported thereon and deposited with the paper onto the elevator platform of the machine. If desired, reduced areas of adhesive may be used to facilitate breaking of these adhesively secured areas. Handle means are provided on the tray to facilitate handling of it.

One or more tie straps preferably encircle the package to hold the cover in place and strengthen the package, and the box components, or at least the first member, may be treated with a moisture vapor barrier material, or other means may be provided to maintain proper moisture content in the paper stored within the box without requiring the use of ream wrap. A shrink wrap may be applied over the box for use in combination with the moisture vapor barrier material, or in lieu thereof, as desired.

The first and second members are easily and economically made from single blanks of folded material and do not require separate fasteners, tear strips, or the like in their construction and use. Consequently, the box enclosure formed thereby can be easily unfolded to gain access to the tray and paper so that the tray and paper can be deposited directly onto the elevator platform of the supply bin.

The box of the invention may be made of any suitable material, including cardboard, paperboard, plastic, or other material, as desired. The tray, in particular, can be suitably made from cardboard, paperboard, fiber board or the like. Moreover, the package of the invention may be made in any desirable size for holding an appropriate quantity of paper to fill the bin capacities on various photocopiers, printers and other machines that may be used. It is contemplated, however, that the paper capacity of the package according to the invention will range from about 1,500 sheets up to about 2,500 sheets.

The box of the invention does not require modification to existing packaging machinery other than the addition of a means to insert the tray into the package. This may be accomplished either before or after the air table.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
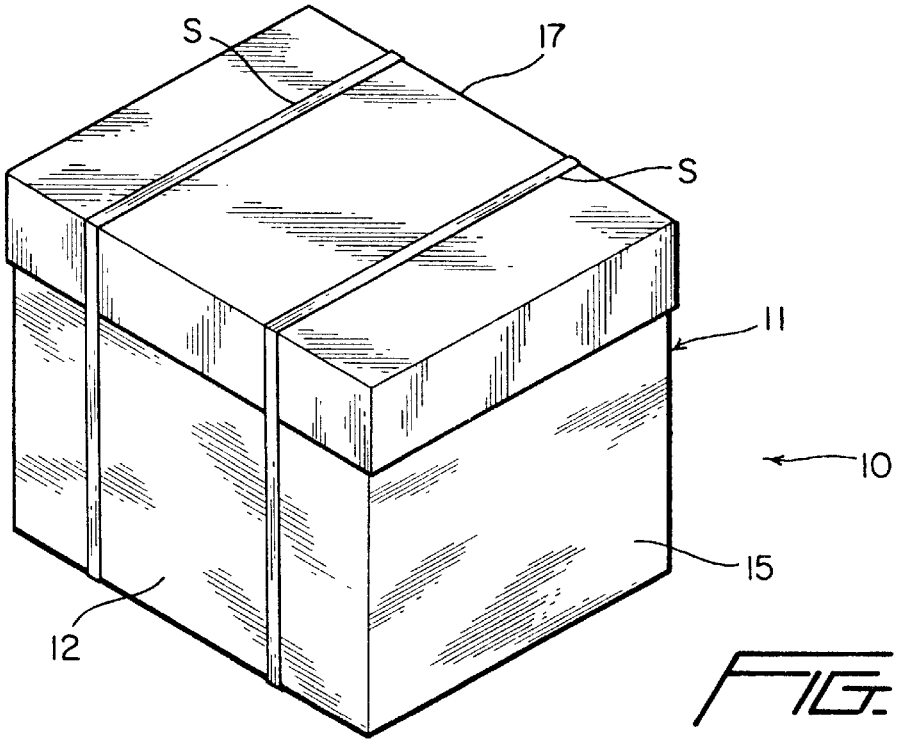
FIG. 1 is a top perspective view of a first form of the bin loader package according to the invention, wherein the package has a pair of tie straps applied to it.

Referring more specifically to the drawings, the bin loader package of the invention is indicated generally at 10 in FIGS. 1–4. The package comprises a box enclosure 11 having opposite side walls 12 and 13, opposite ends walls 14 and 15, a bottom wall 16, a cover or lid 17, an internal tray 19, and one or more encircling tie straps S, if desired. The enclosure is configured to closely encircle and enclose a stack of paper P for use in a photocopier or other machine that uses the paper.

More particularly, the enclosure comprises a first member 18 folded from a single flat blank of material to form a wrapper defining the side and end walls and the bottom of the enclosure, and a second member defining the tray 19, which is similarly formed from a single flat blank of material and is folded to define a bottom wall 20 on which the stack of paper P is supported, and handles 21 and 22 at opposite ends of the bottom 20. Cut-outs 23 and 24 are provided in the handles 21 and 22 for insertion of the fingers of the hands of the user to facilitate lifting of the tray and the paper supported thereon. The openings 23 and 24 may be formed by knock-out panels 25 and 26 (see FIG. 4) joined to the handles by perforated fold lines 27 and 28, respectively, along their top edges, and separated from the handles by a cut line 29 and 30, respectively, around their opposite ends and along their bottom edges. Thus, when ready for use, the user may press his fingers against the knock-out panels 25 and 26, bending them inwardly about the fold lines 27 and 28, respectively, forming the openings through which the fingers may be inserted, and at the same time providing a cushioning element for the fingers.

Inwardly turned end panel flaps 31 and 32 are formed on the opposite ends of side wall 12 of first member 18, and corresponding inwardly turned end panels flaps 31*a* and 32*a* are formed on the opposite ends of side wall 13. The bottom edges of these end panel flaps have shaped cut-outs 33, 34 and 33*a*, 34*a*, respectively, for nestably receiving the handles 21 and 22 so that in the erected box a smooth, flush inner surface is formed at the opposite ends of the box.

Figure 2:
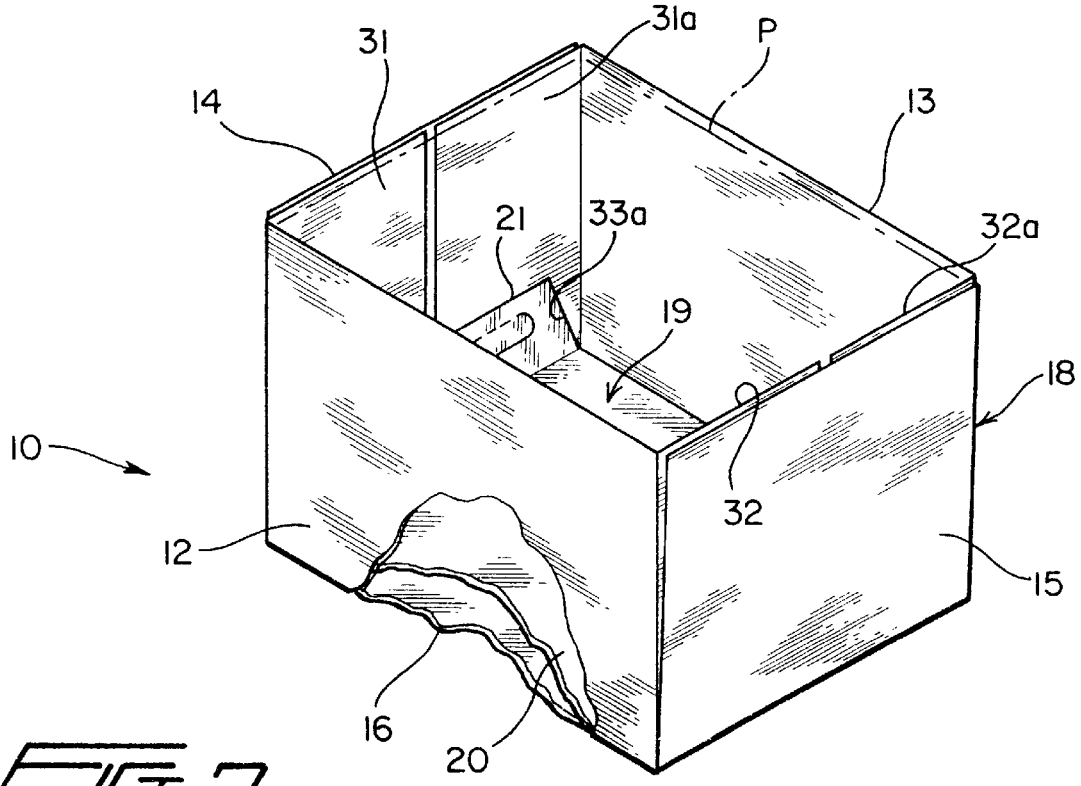
FIG. 2 is a top perspective view of the package of FIG. 1, with portions broken away and showing the tie straps and cover or lid removed.
Figure 3:
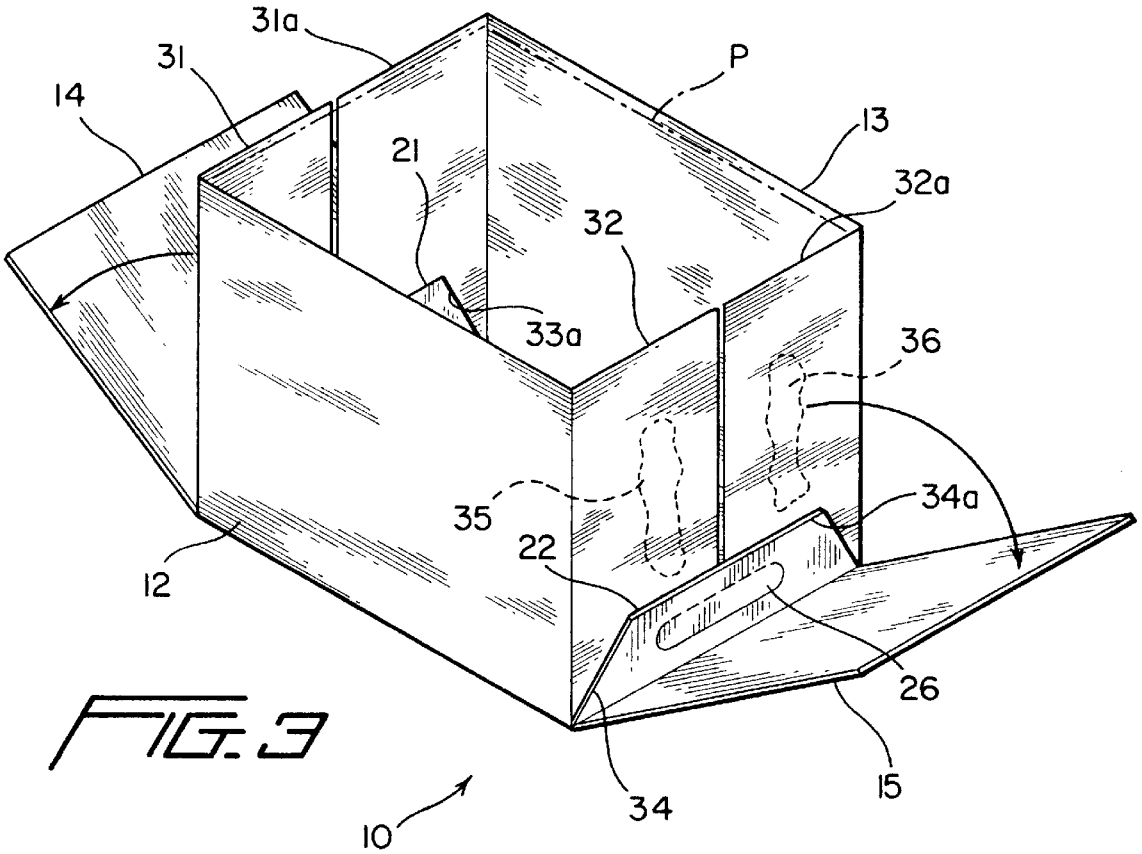
FIG. 3 is a slightly enlarged top perspective view of the package of FIG. 2, showing the first and second members that formed the side walls and bottom of the box enclosure of the package, and depicting how the glue joints between the side and end walls of the first member may be broken to enable the end walls to be folded down.
Figure 6:
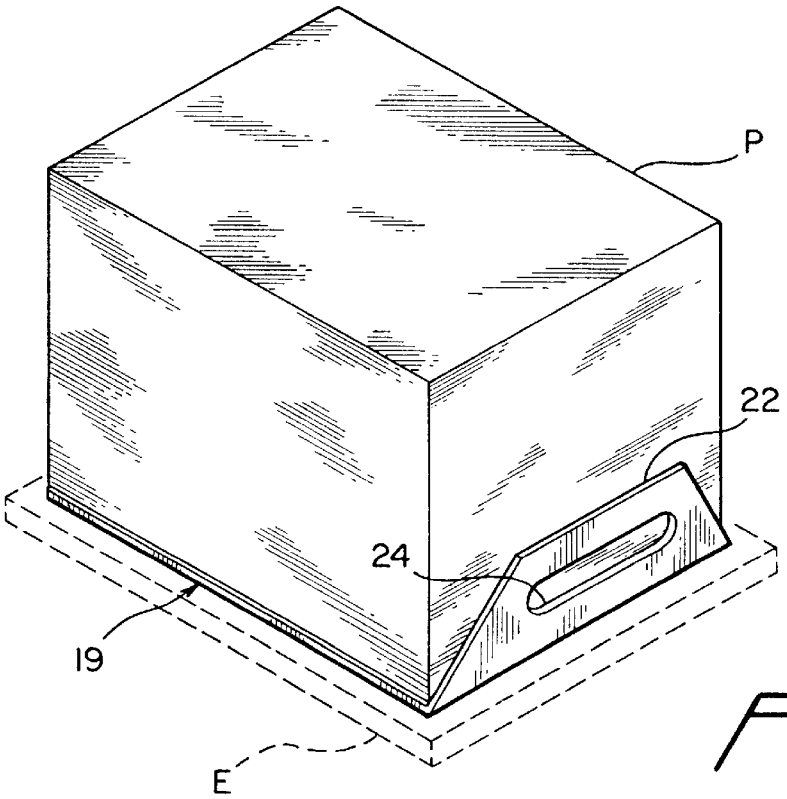
FIG. 6 is a top perspective view showing the tray and stack of paper, deposited onto the elevator platform, ready for use.
Figure 4:
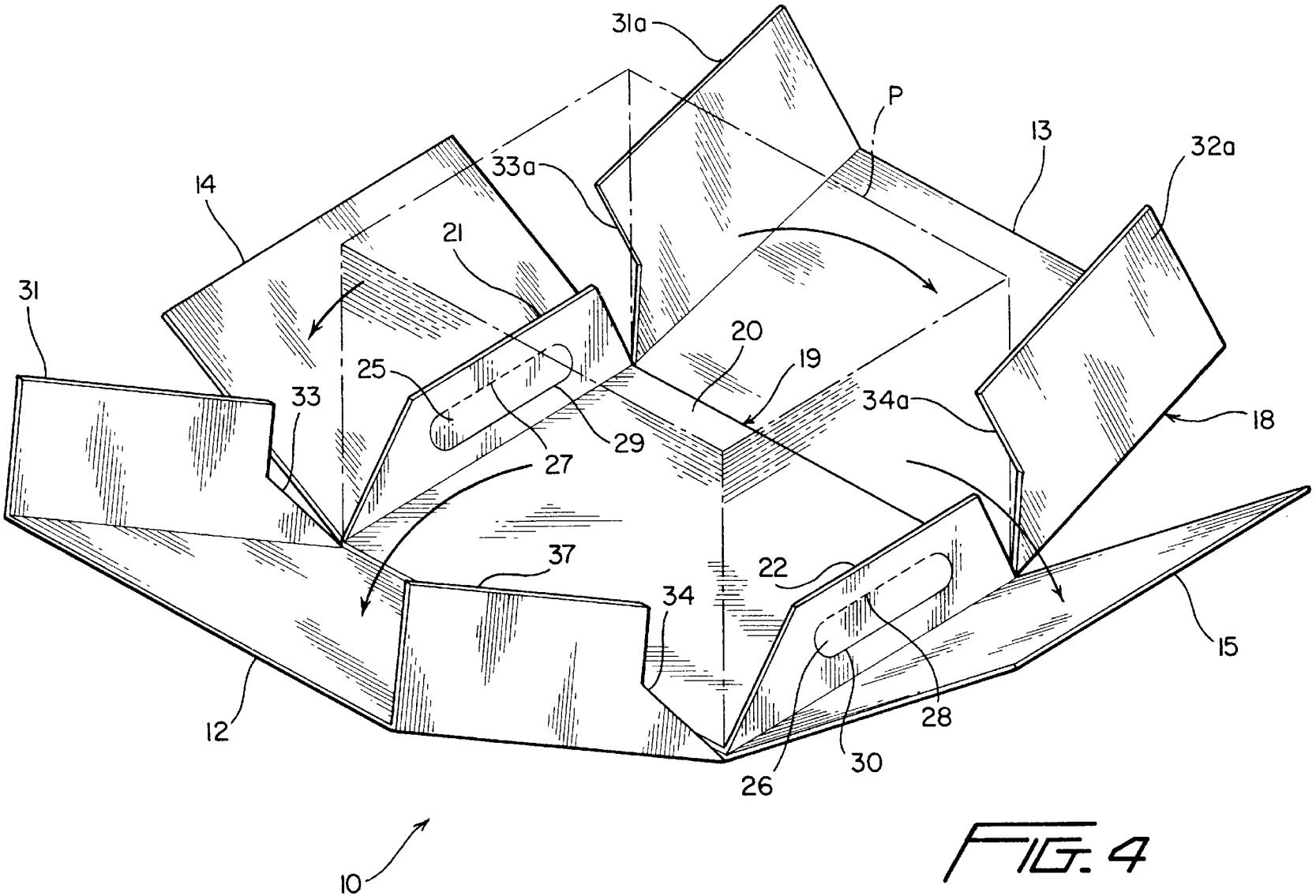
FIG. 4 is a top perspective view of the package of FIG. 3, showing the side and end walls of the first member folded downwardly to expose the tray handles and free the stack of paper supported thereon so that the tray and paper can be lifted away from the first member and placed in the paper supply bin of a copier or other machine.
Figure 5:
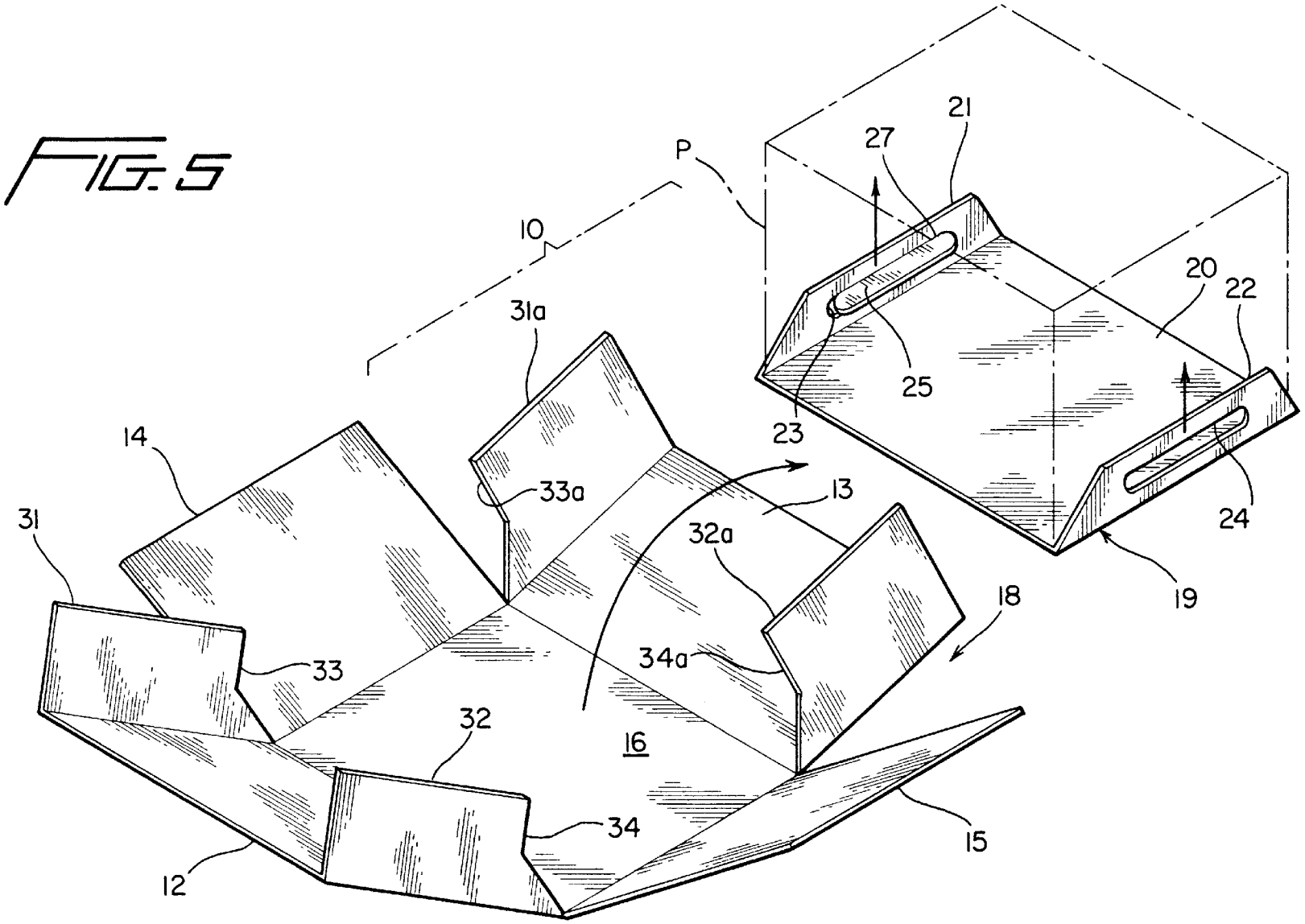
FIG. 5 is an exploded top perspective view of the package of the invention, showing the tray and stack of paper being lifted away from the wrapper.

Patches of adhesive 35 and 36 at each end of the box adhesively attach the end walls 14 and 15 to the end wall panels 31, 31*a* and 32, 32*a*, respectively, to hold the box in its erected position as shown in FIG. 2. When it is desired to deposit the paper held within the box into the paper supply bin of a photocopier or other machine, the adhesive attachments between the end walls and the adjacent end flaps may be broken by pulling outwardly and downwardly on the end walls. This enables the end walls and the side walls to be folded downwardly and outwardly away from the stack of paper and the tray 19, whereby the user may insert his fingers through the shaped openings 23 and 24 in the handles 21 and 22 of the tray to facilitate lifting of the tray and the stack of paper held thereon for deposit of the tray and the paper onto the elevator platform E for use of the paper (see FIGS. 3 through 5). The machine may then access the paper from a side which is devoid of a handle, whereby the tray may be left in place in the machine during use of the paper supported thereon.

Figure 7:
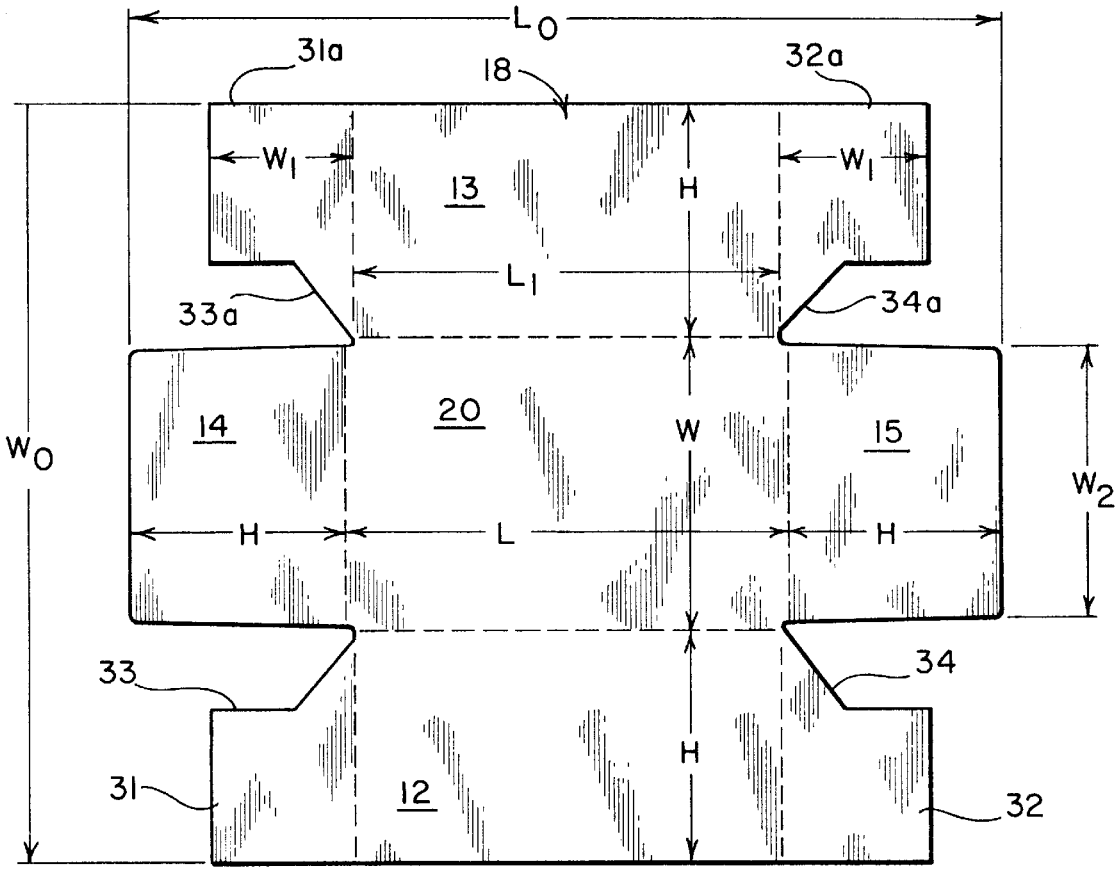
FIG. 7 is a top plan view of the blank used to form the first member.
Figure 8:
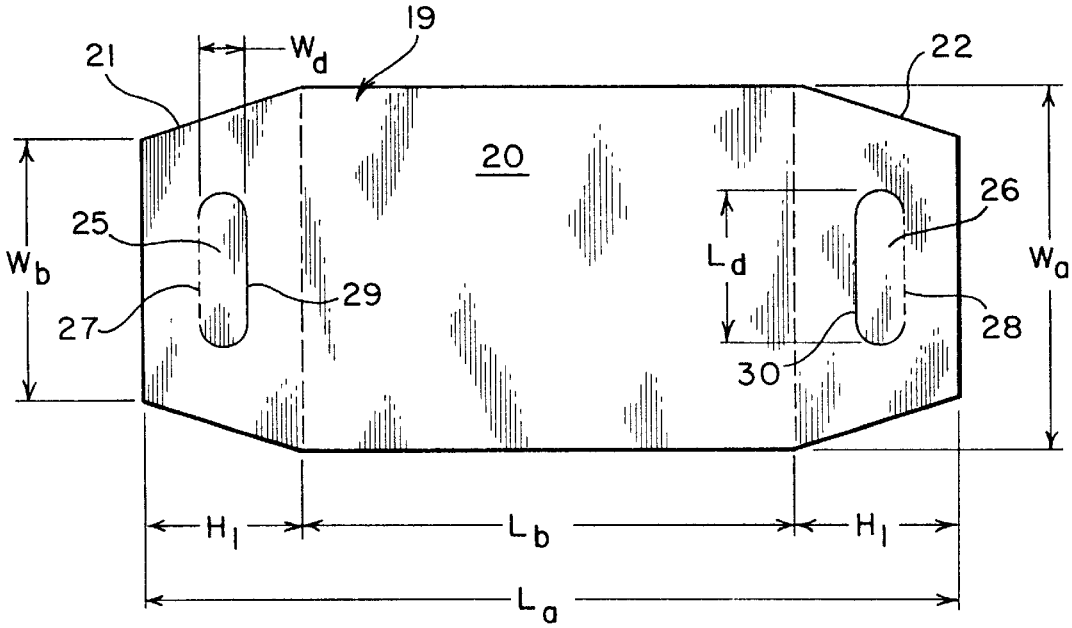
FIG. 8 is a top plan view of the blank used to form the second member or tray.

As seen best in FIG. 7, the opposite side edges of the end walls 14 and 15 are tapered slightly inwardly toward their upper or outer ends, and the end panel flaps 31, 31*a* and 32, 32*a* each has a width dimension $W_1$ equal to approximately half the width dimension $W_2$ of the end walls 14 and 15, whereby in the erected box the end panel flaps extend into juxtaposition with one another at their inner edges. Additionally, the length $L_1$ of the side walls 12 and 13 is slightly less than the length L of the bottom wall 20, so that the end panels 31, 31*a* and 32, 32*a* can be folded inwardly in parallel relationship against the inner surface of the end walls 14 and 15.

In a specific construction of a box according to the invention, the side walls 12 and 13 and end walls 14 and 15 all have the same height H, which in a specific construction may be 9 13/16 inches, with the bottom wall 20 having a length L of 11 5/16 inches and the opposite side walls 12 and 13 having a length $L_1$ of 11 3/16 inches. The end walls 14 and 15 have a width W at their base end equal to the width of the bottom wall 20, and a width $W_2$ at their outer ends that is 8 1/16 inches. The end panel flaps 31, 31*a* and 32, 32*a* all have a width $W_1$ of 4 5/16 inches. With these dimensions, the blank forming the first member or wrapper 18 has an overall length $L_o$ of 30 15/16 inches and an overall width $W_o$ of 28 5/16 inches. It should be understood that these specific dimensions are for a specific box construction, and other dimensions may be utilized depending upon the requirements of the particular box.

For a box having a first member 18 with the dimensions as described above, the blank forming the tray or second member 19 has an overall unfolded length $L_a$ of 17 3/16 inches, with the central portion forming the bottom wall 20 having a length $L_b$ of 11 3/16 inches. Each of the handles 21 and 22 has a height $H_1$ of 3 inches and a width $W_b$ at their upper or outer ends of 6 inches. The knock-out panels 25 and 26 in the handles 21 and 22 each has a length $L_d$ of 4 1/4 inches and a width $W_d$ of 1 inch, centered 1 inch inwardly from the transverse fold line separating the handle from the bottom, and 1 inch from the outer or upper edge of the handle. Again, it should be understood that these dimensions are for a specific construction only, and may be varied depending upon the dimensions of the first member 18 and the particular requirements of the box.

The wrapper or first member 18 and the tray or second member 19 may be formed of any suitable material, such as corrugated cardboard, paper board, fiber board and the like. Moreover, one or both of these members may be treated with a suitable moisture vapor barrier material, such as that described in commonly owned pending patent application Ser. No. 08/587785.

The invention is particularly advantageous in that it may be produced on existing machinery without requiring modifications to the machinery, except for the provision of a means to insert the tray during the process of loading paper into the box. The tray may be inserted into the process either before or after the air table. Thus, paper may first be placed on the tray and the tray then set onto the blank which forms the first member 18, and the blank then folded upwardly about the tray and the paper to construct the box enclosure; or, the tray may first be placed in the center of the blank, and the paper then stacked thereon, after which the blank 18 is folded upwardly to define the box enclosure. It will thus be seen that the package according to the invention provides a simple, economical and efficient means of storing and handling paper as well as depositing it onto the elevator platform of a photocopier or other machine. With the invention there is no need to directly handle the paper itself, and an entire box, typically five reams, may be deposited at one time into the paper supply bin.

The package of the invention does not require modification of existing machinery in order to produce it, other than the addition of a means to insert the tray, and thus presents an economical and simple solution to the problem of rapidly supplying paper to high speed photocopiers and other machines which use paper at a high rate.

While particular embodiments of the invention have been illustrated and described in detail herein, it should be understood that various changes and modifications may be made to the invention without departing from the spirit and intent of the invention, as defined by the scope of the appended claims.

What is claimed is:

1. A bin loader package for shipping, storing and dispensing cut paper directly into the paper supply bin of a photocopier, printer or other machine having means for storing a supply of paper used in the operation of the machine, comprising:

means defining a box enclosure having opposite side walls, opposite end walls, a top wall and a bottom wall for enclosing a stack of paper sheets to be placed in a photocopier or other machine that uses the paper;

said means including first and second members interengaged with one another to define said box enclosure, said first member defining at least said side and end walls, said bottom wall and an open top, and said second member defining a tray which rests in the box enclosure on the bottom wall and supports the stack of paper thereon, for enclosing and protecting the stack of paper sheets during shipping, storage and handling of the package; and said side and end walls are integrally joined to the bottom wall of said first member and are folded upwardly about the sides of the tray and adhesively attached together to define a wrapper, said adhesive attachment being releasable by exerting force on the side and end walls to enable them to be folded downwardly to expose the stack of paper and enable access to the tray, which may then be lifted with the stack of paper supported thereon and deposited onto the elevator platform of the paper supply bin of a photocopier or other machine in position for use by the machine.

2. A bin loader package as claimed in claim 1, wherein:

the first member and the tray are each made from a single blank folded to form the respective first member and tray, and are assembled together to define said box enclosure without the use of separate fasteners.

3. A bin loader package as claimed in claim 2, wherein:

the first member and tray are made of a material selected from the group consisting of corrugated cardboard, paperboard and plastic.

4. A bin loader package as claimed in claim 1, wherein:

said tray has handle means thereon to facilitate grasping and lifting of the tray and a stack of paper supported thereon.

5. A bin loader package as claimed in claim 4, wherein:

the handle means comprises a hand grip at each end of the tray, formed integrally with the tray, foldable into flush, coplanar relationship with an adjacent end wall of the first member, and extending in substantial vertical alignment with the adjacent end walls of the first member.

6. A bin loader package as claimed in claim 5, wherein:

said adjacent end walls of the first member have cut-outs therein shaped complementally to the handle means for receiving the handle means in flush, nested relationship therein.

7. A bin loader package as claimed in claim 6, wherein:

said tray has a bottom wall, and the handle means comprise foldable flaps on each end of the bottom wall; and each foldable flap has an elongate knock-out panel therein which may be displaced to form an opening in each flap for receiving the fingers of the user of the package to facilitate lifting of the tray and paper thereon.

8. A bin loader package as claimed in claim 4, wherein:

the side and end walls formed by the first member comprise opposite side wall panels and opposite end wall panels, said side wall panels have end flaps integrally joined thereto and folded inwardly toward one another behind the opposite end wall panels, and said end flaps are adhesively attached to the end wall panels to hold the first member in its erected, folded position about the tray and stack of paper.

9. A bin loader package as claimed in claim 8, wherein:

the handle means comprises a hand grip at each end of the tray, formed integrally with the tray, foldable into flush, coplanar relationship with an adjacent end wall of the first member, and extending in substantial vertical alignment with the adjacent end walls; and inner bottom edge portions of the end flaps have cut-outs therein shaped complementally to the handle means for receiving the handle means therein in flush, nested relationship to define a smooth, uninterrupted inner surface in the erected box enclosure.

10. A bin loader package as claimed in claim 1, wherein:

at least the first member is treated with a moisture vapor barrier material to maintain the moisture content of the paper supported in the package within acceptable limits without requiring the use of ream wrap about the sheets of paper or shrink wrap about the package.

11. A bin loader package as claimed in claim 9, wherein:

at least the first member is treated with a moisture vapor barrier material to maintain the moisture content of the paper supported in the package within acceptable limits without requiring the use of ream wrap about the sheets of paper or shrink wrap about the package.

12. A bin loader package as claimed in claim 1, wherein:

the top wall comprises a separate lid placed over the open top of the box enclosure; and at least one tie strap is secured about the package to hold the lid in place and facilitate handling and storage of the package.

13. A method of depositing a stack of paper directly from a package into the paper supply bin of a photocopier, printer, or other machine which uses the paper in its operation, comprising the steps of:

forming a package comprising a stack of paper held within a box enclosure defined by two interconnected members including a first member folded to defined a bottom wall and side and end walls, and a second member defining a tray resting on the bottom of the first member and supporting the stack of paper thereon;

using the package to ship and store the paper;

partially unfolding the first member to expose the paper and gain access to the tray and;

lifting the tray and the paper supported thereon away from the first member and depositing the tray and paper in the paper supply bin of a machine which uses the paper.

* * * * *